US006423374B1

(12) United States Patent
Laursen

(10) Patent No.: US 6,423,374 B1
(45) Date of Patent: Jul. 23, 2002

(54) METHOD AND SYSTEM AND USE OF THE METHOD OR SYSTEM FOR THE APPLICATION OF LACQUER

(75) Inventor: Uffe Laursen, Kerteminde (DK)

(73) Assignee: Ulmadan APS, Odense (DK)

( * ) Notice: Subject to any disclaimer, the term of this patent is extended or adjusted under 35 U.S.C. 154(b) by 0 days.

(21) Appl. No.: 09/647,951

(22) PCT Filed: Apr. 7, 1999

(86) PCT No.: PCT/DK99/00203

§ 371 (c)(1),
(2), (4) Date: Dec. 7, 2000

(87) PCT Pub. No.: WO99/51361

PCT Pub. Date: Oct. 14, 1999

(30) Foreign Application Priority Data

Apr. 7, 1998 (DK) ..... 0498/98
Sep. 25, 1998 (DK) ..... 1998 01218

(51) Int. Cl.[7] ..... B05D 7/08; B05C 1/12

(52) U.S. Cl. ..... 427/284; 427/428; 118/252; 118/258; 118/259

(58) Field of Search ..... 427/284, 428; 118/258–260, 263, 669, 673, 252

(56) References Cited

U.S. PATENT DOCUMENTS 3,847,117 A 11/1974 Widigis
4,070,987 A * 1/1978 Gross et al.
5,298,072 A 3/1994 Schiele
6,180,172 B1 * 1/2001 Hasenkamp et al.

FOREIGN PATENT DOCUMENTS

GB 1489814 1/1975
WO 96/16777 * 6/1996

* cited by examiner

*Primary Examiner*—Fred J. Parker
(74) *Attorney, Agent, or Firm*—Antonelli, Terry, Stout & Kraus, LLP

(57) ABSTRACT

The invention concerns a method for the application of lacquer to edges on plates and lists especially of the porous type which are used within the furniture industry, where by changing the CAD reference dimension of the edge profile lacquer dosing unit it is possible to apply differentiated amounts of lacquer to predetermined areas. The invention also concerns a system for the application of lacquer to the edges on plates and lists, especially of the porous type used in the furniture industry. Among other things, the system comprises one or more application rollers (9), possibly with a groove (10) in the surface of the individual roller (9) which can correspond to the edge profile, (18) to which the lacquer is to be applied. The CAD reference can also be changed in the profile groove (10) of the application roller (9), or in both the roller (9) and the dosing unit (11). By using several units of appication rollers (9) in succession; a particularly fine surface is obtained by allowing the appication roller (9) which is placed last in the direction in which the work piece (18) is fed, to rotate in the opposite direction, whereby the excess lacquer is removed while at the same time a very well-defined thickness of lacquer is achieved. The method and the system are especially applicable in the lacquering of chipboards and similar porous plates which are not homogeneous.

15 Claims, 4 Drawing Sheets

METHOD AND SYSTEM AND USE OF THE METHOD OR SYSTEM FOR THE APPLICATION OF LACQUER

BACKGROUND OF THE INVENTION

The invention concerns a method for the application of lacquer to edges of plates and lists which are used within the furniture industry, and especially of the porous type.

The invention also concerns a system for applying lacquer to the edges of plates and lists which are used within the furniture industry, and especially of the porous type, said system containing one or more application rollers.

With known systems of this type, there have always been problems with the dosing of lacquer on edges of porous materials, such as e.g. MDF plates (MDF=Medium Density Fibreboard) or possibly also chipboards. The greatest problem is that of achieving a lacquer layer of even thickness and of uniform drying. In the application of lacquer to chipboards, the lacquer will penetrate deeper into the core of the board, in that the structure at this point is far more porous than the remaining parts of the board. This accumulation of lacquer in the middle of the board is very inexpedient, in that the lacquer will practically speaking not harden, and thus over a long period of time will emit vapours from the solvents existing in the lacquer. This is not particularly fortunate, especially not if the lacquered boards are used for furniture for e.g. a kitchen or a children's room.

It has also long been a problem to lacquer edges on several items over a short period of time. One of the methods earlier used as a solution has been to spray the lacquer on the items in a stack. This is difficult to do without the lacquer accumulating in runs or droplets when the edge of the item is not of a homogeneous structure, and therefore neither is a uniform absorption of the lacquer achieved. In making sure that the item has received the necessary amount of lacquer over the whole of the edge, some places will invariably receive too much, which results in the undesirable accumulations of lacquer which must subsequently be machined, e.g. by grinding.

In many cases, this process must be repeated up to several times, which not only makes the lacquering process more costly but also prolongs the processing time.

Another way in which to solve the problem can be as shown in U.S. Pat. No. 4,070,987, which describes an apparatus which lacquers the edges by means of an endless belt, a so-called edge-belt. This method suffers the disadvantages, among other things, that the actual application of the lacquer is not particularly precise, and that a precise application on different profiles can not be achieved without difficulties, in that the method is intended only for applying a top coating of lacquer to pre-processed items.

It is also known to apply lacquer to edge profiles with a system using rollers, whereby edge profiles can be lacquered by means of two corresponding rollers, a dosing roller and an application roller. Here, there is the problem that it is rather expensive to have to change the profile on the application unit, in that the production cost of a set of corresponding rollers for the application of the lacquer is very high. Moreover, these rollers are heavy, which means that it is a slow and often troublesome process to replace them with a set of rollers with another profile.

SUMMARY OF THE INVENTION

With the invention, these problems are solved by using the following method with associated system. After pre-processing of the edge, which can involve profile milling and sanding, a layer of lacquer, preferably a highly-viscous acrylic lacquer, is applied to the edge by means of the system according to the invention for the application of lacquer to edge profiles. The lacquer is then hardened using known hardening methods, e.g. by means of ultraviolet light, after which the lacquer is ground and the item/edge is now ready for the top coating or the application of foil by thermal impregnation. In the top coating, use is made of a lacquer with lower viscosity, with which the system can also operate, in that it is possible when necessary to adjust the lacquer transport roller in accordance with the viscosity of the lacquer being used.

The most decisive factor in the application of the lacquer is the actual dosing of the lacquer over the edge profile to be lacquered. With the system according to the invention, a very precise dosing is effected, so that the lacquer can be applied with regard to the differentiated absorption capacity of the surface structure of the work piece. At the same time, the invention also makes it possible for the profile on the application roller and the dosing unit to be changed in an easy, quick and inexpensive manner.

The dosing unit itself consists of a relatively thin plate, which at the one end is shaped approximately the same as the edge profile on the item to be lacquered. The contour of the lacquer dosing unit or CAD reference profile is in some cases identical with the CAD reference profile in the application roller. The lacquer pressure chamber, which at all times when the system is in operation supplies the lacquer dosing unit with lacquer at a constant pressure, together with a horizontal adjustment system, has made it possible to provide the edge with a very accurate dosing of lacquer.

To counter those situations where, for example, an edge profile can be an inclined profile and herewith have a large unfolded surface in the core layer, which will absorb more lacquer than a face layer, the lacquer dosing unit itself can be produced with varying CAD reference dimensions, whereby it is taken into consideration that more lacquer can be applied to the core layer in the above-mentioned situations and with greater item thickness. This will be the case for approximately 50% of the MDF and chipboard edge profiles which are known on the present market.

In addition, it is also possible to change the CAD reference profile in the application roller, or in some cases even change the profile both in the application roller and on the lacquer dosing unit in order to achieve a differentiated lacquer dosing across the profile of the item, for example to apply more lacquer to the core layer of items of greater thickness, and where e.g. an edge profile could have a gradient of approx. 30–45 degrees in relation to the vertical, and herewith have a great unfolded surface in the core layer, with subsequently greater local absorption.

A condition for this precise dosing to be able to be effected is that there is a unit which can deliver the necessary amount of lacquer and the necessary pressure. This is taken care of by a lacquer transport roller. This lacquer transport roller is made up of a number of pressure chambers which ensure that the necessary pressure exists.

The system can be used for the lacquering of edge profiles made of e.g. MDF, HDF (High Density Fibreboard), masonite, chipboard etc. These types are not mentioned as limitations, but because they contain the types of edges which are most difficult to provide with a correct edge lacquering. The system will be able to be used for the lacquering of all normal types of materials which are used for edge profiles.

For items where the face layer and the core layer have more or less the same absorption capacity, the profile of the edge dosing profile is identical with the edge profile groove in the lacquer application roller. The lacquer dosing unit is mounted in sleeves for adjustment in both the horizontal and the vertical direction. This contributes towards ensuring that a uniform and constant amount of lacquer is applied over the edge of the item.

Another advantage of the system of this type is that it takes up very little installation space.

In the event of a possible stoppage of the material supply line, the lacquer application unit automatically moves away from the edge of the item, so that lacquer is not wasted on the surface of the item, and the unit is automatically coupled again when the material supply line is re-started.

In the construction of the system, regard has also been paid to easy cleaning of the lacquer application unit, in that a limited cleaning is adequate providing that it is ensured that the lacquer application part is covered in protection against light.

DETAILED DESCRIPTION OF THE PREFERRED EMBODIMENTS

Figure 1:
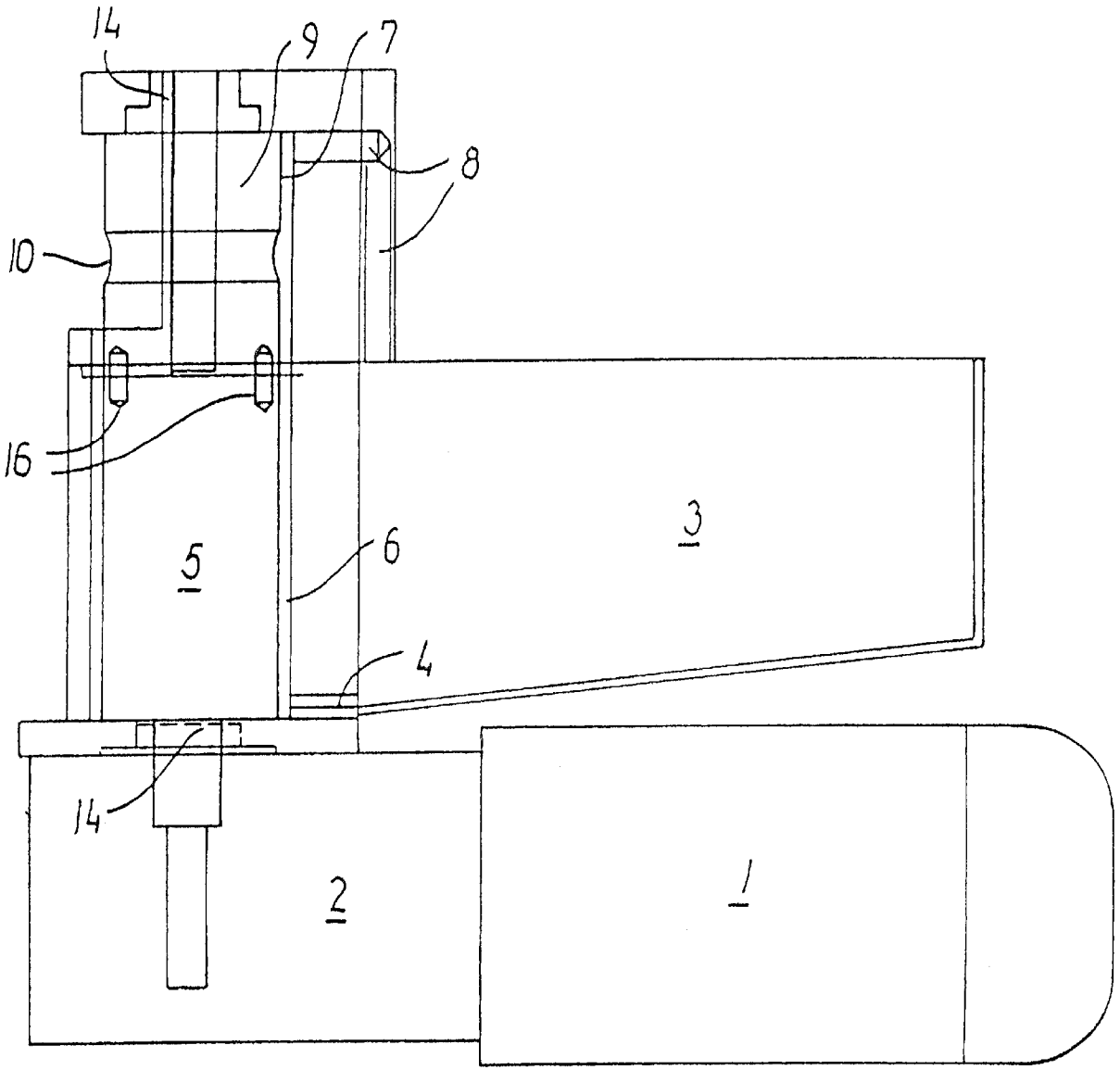
FIG. 1 shows the lacquer application system seen from the side.
Figure 2:
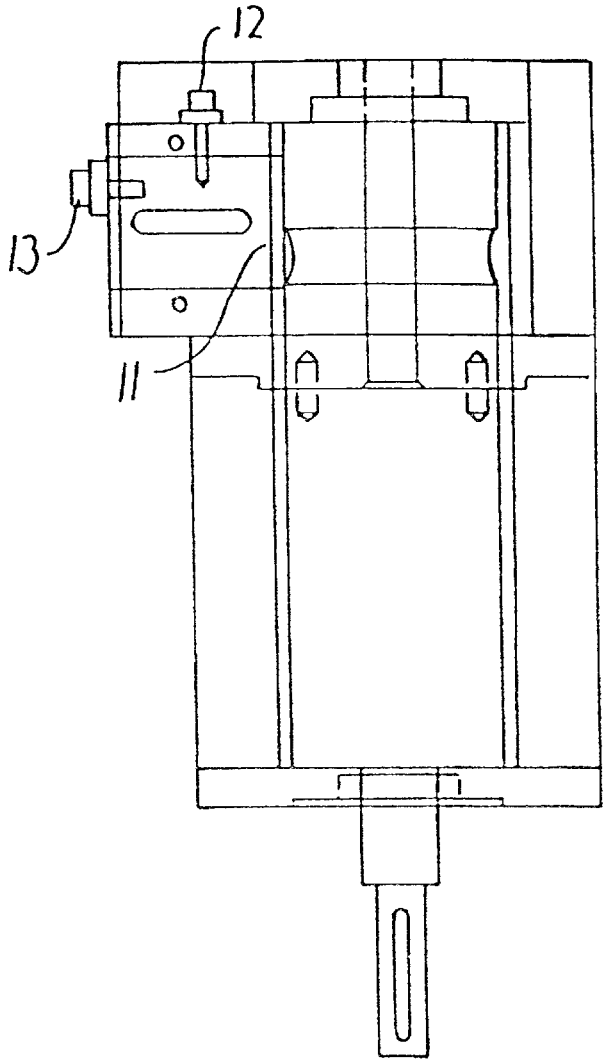
FIG. 2 shows the lacquer application system without drive unit and lacquer container, seen from the item side.
Figure 3:
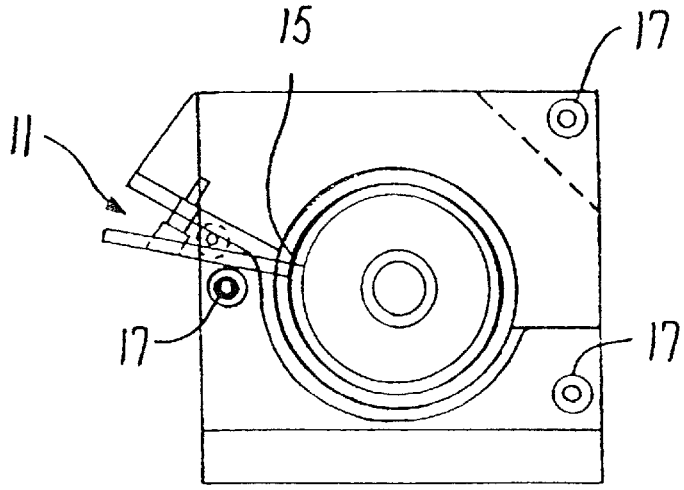
FIG. 3 shows the lacquer application system without drive unit and lacquer container, seen from above.
Figure 4:
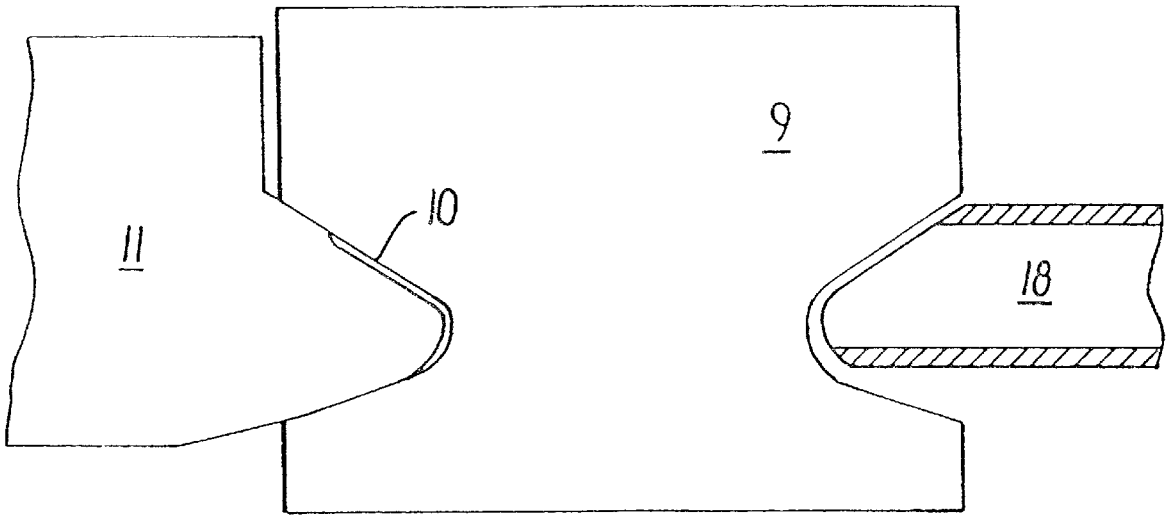
FIG. 4 shows an application roller together with an item and lacquer profile dosing unit.
Figure 5:
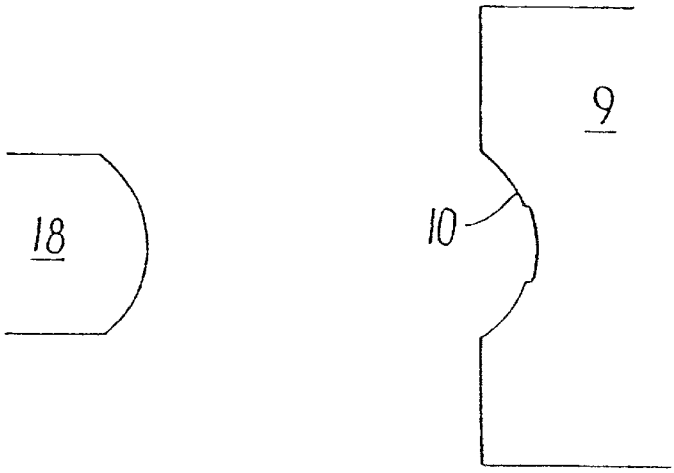
FIG. 5 shows an application roller with sectioned profile groove and an item.

A system for the application of lacquer on edges of plates 18 according to the invention is built up of a drive unit 1, which can be a motor unit which is frequency-controlled or controlled in another manner, and which transfers its driving power by means of a transmission unit 2. A lacquer reservoir 3 contains the lacquer which is to be applied to the items 18, said lacquer being led through a lacquer supply channel 4 to a lacquer friction transport roller 5 which forms the innermost part of a lowermost lacquer friction chamber 6, which at a distance between the transport roller 5 and an outer wall in the friction chamber, said distance being dependent on the viscosity of the lacquer used for the relevant item 18, permits transport of lacquer, preferably highly-viscous acrylic lacquer, via a substantially upwardly winding feed channel, which by pre-processing is formed in the outer wall of the friction chamber 6 up to an uppermost pressure chamber 7, the main lacquer pressure chamber. In a preferred embodiment, the low-friction transport roller is configured in steel and with a smooth surface. Uppermost in the main lacquer pressure chamber 7 there is a lacquer overpressure channel 8 which ensures that the lacquer has a uniform pressure in the main pressure chamber, and that excess lacquer is re-circulated to the lacquer reservoir 3. In FIG. 4, a lacquer application roller 9 is placed on the same axle as the transport roller 5. The cylindrical surface of this lacquer application roller 9 corresponds in profile 10 to that edge to which the lacquer is to be applied, so that the profile 10 in the roller is adapted to the CAD reference profile of the processed edge of the item 18. For the transfer of the lacquer to the lacquer application roller 9, there is constructed an edge profile lacquer dosing unit 11, where in the ideal case the CAD reference of this dosing profile 11 is identical with the edge profile groove in the lacquer application roller 9. In cases which can not be considered as being ideal, compensation is made by changing the CAD reference profile on the roller, on the dosing unit or on them both. Such cases are, for example, when lacquer is to be applied to a porous plate, e.g. chipboard edge. Since a part of the lacquer will be absorbed in the core layer, the surface will not be covered uniformly. Therefore, it is necessary to compensate for the differentiated application amount seen over the cross-section of the profile. With the method according to the invention, the solution to this is to change the CAD reference dimension of the lacquer dosing unit in such a way that the layer of lacquer which is applied on the core layer of the item 18 becomes thicker with decreasing thickness towards the horizontal surfaces of the item 18. The lacquer profile dosing unit is preferably produced in a material which can easily be pre-processed, which in some cases is a special brass, but in other cases can be e.g. plastic, nylon, steel or the like.

The lacquer application roller 9 can be produced from different materials, and the roller can also have different surface roughness depending on what kind of finish is desired on the items 18. The size of the roller can vary depending on the shape of the item 18, and subsequently the necessary depth and height of the groove in the roller.

To obtain the best possible dosing of the lacquer, means of adjustment are provided in both the vertical and the horizontal direction 12, 13 in connection with securing of the dosing unit 11 to the system. Bearings 14 are provided in the one end of the main pressure chamber 7, and in opposite ends of the lowermost pressure chamber 6, or lacquer friction chambers. The actual dosing of the lacquer takes place at a transfer point 15, where the lacquer from the main pressure chamber 7 is transferred via the profile dosing unit 11 to the profile groove 10 in the application roller 9.

In order to ease the dismantling and mounting of the main pressure chamber 7 when possibly replacing the application roller 9, some form of guide 16 can be provided between the units which respectively contain the lacquer transport roller 5 and the lacquer profile application roller 9. Moreover, the uppermost of the units containing pressure chamber 7, application roller 9 and dosing unit 11, are provided with a number of securing elements 17 for quick dismantling and mounting.

The whole of the system can possibly be mounted on a machine column with floating movement vertically and horizontally. Moreover, the whole of the system can work at other angles than in the horizontal position, in that it functions as a closed system.

The lacquer application system itself can also be built up of several lacquer application sections which can run in the same or opposite directions or with individually variable speeds.

Figure 6:
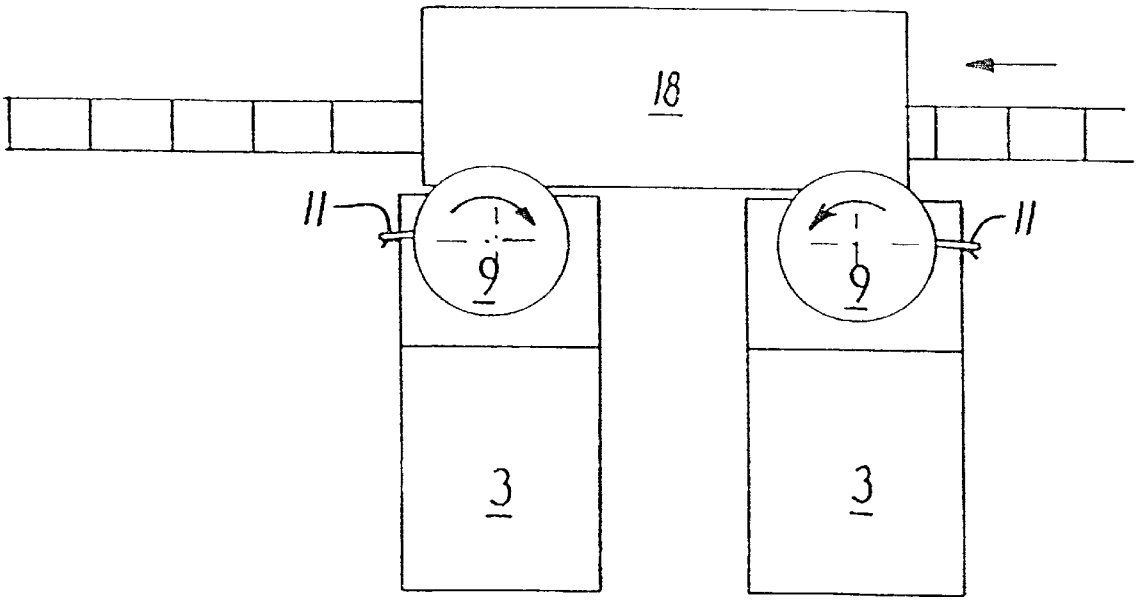
FIG. 6 shows an embodiment where use is made of several units, one of which runs in the opposite direction.

In a special embodiment as shown in FIG. 6, the lacquer application can be followed by a special calibration of the lacquer, i.e. a smooth profiled roller can be used to remove a part of the lacquer which has been applied, and hereby give the item a particularly well-defined lacquer thickness. The excess lacquer is led via the lacquer profile dosing unit, which in this case together with the profiled roller runs in the opposite direction, over into a collection vessel or back to the lacquer reservoir 3.

In the description of the system, use has been made of terms such as lacquer and paint, but it is envisaged that it can be used to a wider extent in connection with the application of liquid materials on edges, for example the application of glue or the like to edge surfaces.

The system is used especially for the application of lacquer on edges of plates and lists, where lists are to be understood to be smooth or profiled lists which are possibly required to be lacquered on all sides and/or edges.

What is claimed is:

1. A method for the application of lacquer on edges of a work piece selected from the group consisting of plates and lists, comprising:

providing a lacquer application roller;

providing a lacquer dosing unit adjacent the lacquer application roller;

transferring lacquer from the lacquer dosing unit to the lacquer application roller; and applying lacquer from the lacquer application roller to an edge of the work piece, said edge having a profile;

wherein a CAD reference profile of at least one of the lacquer application roller and the lacquer dosing unit is selected to be different than a CAD reference profile of at least a portion of the edge profile the work piece to apply differentiated dosings of lacquer to predetermined areas of the edge of the work piece.

2. Method according to claim 1, wherein the CAD reference dimension of the lacquer dosing unit is selected to be different than the CAD reference dimension of the work piece, to apply differentiated layers of lacquer to predetermined areas of the edge of the work piece.

3. Method according to claim 2, wherein the CAD reference dimension of the lacquer application roller is selected to be different than the CAD reference dimension of the work piece to apply differentiated layers of lacquer to predetermined areas of the edge of the work piece.

4. Method according to claim 1, wherein the work piece is a porous plate which is not homogeneous.

5. Method according to claim 1, wherein the workpiece is a chipboard.

6. Method according to claim 1, wherein the CAD reference dimension of the lacquer application roller is selected to be different than the CAD reference dimension of the work piece to apply differentiated layers of lacquer to predetermined areas of the edge of the work piece.

7. A system for the application of lacquer on edges of a work piece selected from the group consisting of plates and lists, comprising:

a lacquer application roller for applying lacquer from the lacquer application roller to an edge of the work piece; and a lacquer dosing unit adjacent the lacquer application roller for transferring lacquer from the lacquer dosing unit to the lacquer application roller;

wherein a CAD reference profile of at least one of the lacquer application roller and the lacquer dosing unit is to be different than a CAD reference profile of at least a portion of an edge profile the work piece to apply differentiated dosings of lacquer to predetermined areas of the edge of the work piece.

8. System according to claim 7, wherein the CAD reference profile of the lacquer dosing unit is different than the CAD reference profile of the work piece.

9. System according to claim 8, wherein a groove is provided in the surface of the lacquer application roller, the groove having a profile different than the CAD reference profile of the work piece.

10. System according to claim 9, wherein the groove in the surface of the lacquer application roller is different in sections in relation to the CAD reference profile of the work piece.

11. System according to claim 7, comprising a plurality of lacquer application rollers, wherein a groove in the surface of one of the lacquer application rollers corresponds to the CAD reference profile of the work piece.

12. System according to claim 7, comprising a plurality of lacquer application rollers, wherein a lacquer application roller placed last in the processing sequence rotates in a direction opposite the rotation direction of the remaining lacquer application rollers.

13. System according to claim 7, wherein the direction of rotation and/or the speed of the lacquer application roller can be varied depending on the desired result, and on the work piece to be processed.

14. System according to claim 7, wherein the CAD reference dimension of the lacquer application roller is different than the CAD reference dimension of the workpiece to apply differentiated layers of lacquer to predetermined areas of the edge of the work piece.

15. System according to claim 8, wherein the CAD reference dimension of the lacquer application roller is different than the CAD reference dimension of the workpiece to apply differentiated layers of lacquer to predetermined areas of the edge of the work piece.

* * * * *